US009812117B1

(12) United States Patent
Mantese et al.

(10) Patent No.: US 9,812,117 B1
(45) Date of Patent: Nov. 7, 2017

(54) COHERENT ACOUSTIC WAVE GENERATION

(71) Applicant: United Technologies Corporation, Farmington, CT (US)

(72) Inventors: Joseph V. Mantese, Ellington, CT (US); Arthur Blanc, Providence, RI (US); Antonio M. Vincitore, South Windsor, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 283 days.

(21) Appl. No.: 14/614,555

(22) Filed: Feb. 5, 2015

Related U.S. Application Data

(60) Provisional application No. 62/096,679, filed on Dec. 24, 2014.

(51) Int. Cl.
*G10K 11/00* (2006.01)
*G10K 11/26* (2006.01)

(52) U.S. Cl.
CPC ..... *G10K 11/26* (2013.01)

(58) Field of Classification Search
CPC ..... G10K 11/04; G10K 11/18; G10K 11/26
See application file for complete search history.

(56) References Cited

U.S. PATENT DOCUMENTS

2004/0047485 A1* 3/2004 Sherrit ..... B06B 3/00 381/340
2007/0258328 A1* 11/2007 Zlotnik ..... G10K 15/04 367/139
2012/0101495 A1* 4/2012 Young ..... A61B 17/29 606/41
2013/0025961 A1* 1/2013 Koh ..... F16F 15/02 181/207
2015/0088154 A1* 3/2015 Vaitekunas ..... A61B 17/12 606/128

* cited by examiner

*Primary Examiner* — Luke Ratcliffe
*Assistant Examiner* — Hovhannes Baghdasaryan
(74) *Attorney, Agent, or Firm* — Cantor Colburn LLP

(57) ABSTRACT

An acoustic wave generator including a stack having a plurality of first layers configured to receive electrical and/or magnetic energy and a plurality of second layers configured in contact with the plurality of first layers, the plurality of second layers comprising one or more materials configured to change mechanical properties when electrical and/or magnetic energy is applied thereto. The generator further having at least one source configured in operational communication with the plurality of first layers and configured to supply at least one of phased electrical and/or magnetic energy to the plurality of first layers, wherein the stack is configured to (i) generate phased acoustic energy and (ii) at least one of amplify and store the generated phased acoustic energy in a first state and release said generator acoustic energy in a second state.

15 Claims, 6 Drawing Sheets

COHERENT ACOUSTIC WAVE GENERATION

CROSS REFERENCE TO RELATED APPLICATIONS

This application claims the benefit of an earlier filing date from U.S. Provisional Application Ser. No. 62/096,679, filed Dec. 24, 2014, the entire disclosure of which is incorporated herein by reference.

BACKGROUND OF THE INVENTION

The embodiments herein generally relate to acoustic wave generation and more particularly to coherent acoustic wave generation by electrically stimulated non-linear materials.

Unlike light amplification by stimulated emission of radiation ("LASER") devices, acoustic waves traditionally are focused using high power, large system techniques. The ability to send and receive focused acoustic radiation over 100s to 1000s of meters currently requires large parabolic acoustic dishes that, at best, focus incoherent acoustic radiation into a solid angle about the direction of desired propagation. Alternatively, planar phased-arrays may be used to produce intense directional acoustic radiation.

Further, transmission of acoustic energy between two different media, e.g., a solid and a fluid, is difficult as there is a strong discontinuity of acoustic impedances at the interface between the two mediums. For example, acoustic waves typically propagate very fast in solids (e.g., steel) and much slower in fluids (e.g., air or water). If proper impedance matching is not provided, the energy does not transmit efficiently at the interface between the two mediums because energy is reflected at the interface back into the source of acoustic energy.

BRIEF DESCRIPTION OF THE INVENTION

According to one embodiment, an acoustic wave generator is provided including a stack having a plurality of first layers configured to receive electrical and/or magnetic energy and a plurality of second layers configured in contact with the plurality of first layers, the plurality of second layers comprising one or more materials configured to change mechanical properties when electrical and/or magnetic energy is applied thereto. The generator further having at least one source configured in operational communication with the plurality of first layers and configured to supply at least one of electrical and/or magnetic energy to the plurality of first layers, wherein the stack is configured to (i) generate acoustic energy and (ii) at least one of amplify and store the generated acoustic energy in a first state and release said generator acoustic energy in a second state.

In addition to one or more of the features described above, or as an alternative, further embodiments may include, wherein at least one of the plurality of first layers comprises an electrode.

In addition to one or more of the features described above, or as an alternative, further embodiments may include, wherein at least one layer of the plurality of second layers comprises at least one of a piezoelectric material and a magnetostrictive material.

In addition to one or more of the features described above, or as an alternative, further embodiments may include, wherein at least one layer of the plurality of second layers comprises a piezoelectric ceramic or a piezoelectric crystal.

In addition to one or more of the features described above, or as an alternative, further embodiments may include, wherein the plurality of first layers and the plurality of second layers form a stack with a repeating pattern of a first layer, followed by a second layer, followed by another first layer, followed by another second layer.

In addition to one or more of the features described above, or as an alternative, further embodiments may include a gate configured to have a closed state and an open state, wherein when the gate is in the closed state the stack is in the first state and when the gate is in the open state the stack is in the second state.

In addition to one or more of the features described above, or as an alternative, further embodiments may include, wherein the gate is formed of a metamaterial.

In addition to one or more of the features described above, or as an alternative, further embodiments may include a horn configured to modify an acoustic impedance of the generated acoustic energy prior to transmission of the acoustic energy from the acoustic wave generator.

In addition to one or more of the features described above, or as an alternative, further embodiments may include, wherein the horn is configured to match an impedance of the generated acoustic energy with an impedance of a material into which the generated acoustic energy is to be transmitted.

In addition to one or more of the features described above, or as an alternative, further embodiments may include at least one third layer in the stack, the third layer configured to store acoustic energy when the stack is in the first state.

In addition to one or more of the features described above, or as an alternative, further embodiments may include, wherein the at least one third layer comprises a high Q Factor material.

According to another embodiment, a method of transmitting acoustic energy is provided. The method including generating acoustic energy within a stack having a plurality of first layers and a plurality of second layers, storing the generated acoustic energy within the stack in a first state, and releasing the generated acoustic energy within the stack in a second state.

In addition to one or more of the features described above, or as an alternative, further embodiments may include, wherein the plurality of first layers are configured to receive electrical and/or magnetic energy, and the plurality of second layers are configured in contact with the plurality of first layers, the plurality of second layers comprising one or more materials configured to change mechanical properties when electrical and/or magnetic energy is applied thereto.

In addition to one or more of the features described above, or as an alternative, further embodiments may include closing a gate to place the stack in the first state and opening the gate to place the stack in the second state.

In addition to one or more of the features described above, or as an alternative, further embodiments may include altering the acoustic impedance of the generated acoustic energy to match an acoustic impedance of a material into which the acoustic energy is to be transmitted.

Technical features of the invention include providing a layered or stacked actuator with piezoelectric ceramics/crystals with interleaving electrical layers that are configured to generate acoustic waves. Further technical features include an acoustic energy generator configured to accumulate and amplify the acoustic energy generated within the generator, to thus provide a low energy input, high energy output acoustic wave generator. Further technical features of the invention include providing an acoustic horn configured to modify and equalize acoustic impedance between an acoustic energy source and a medium in which the energy is intended to be transmitted.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION OF THE INVENTION

Figure 1:
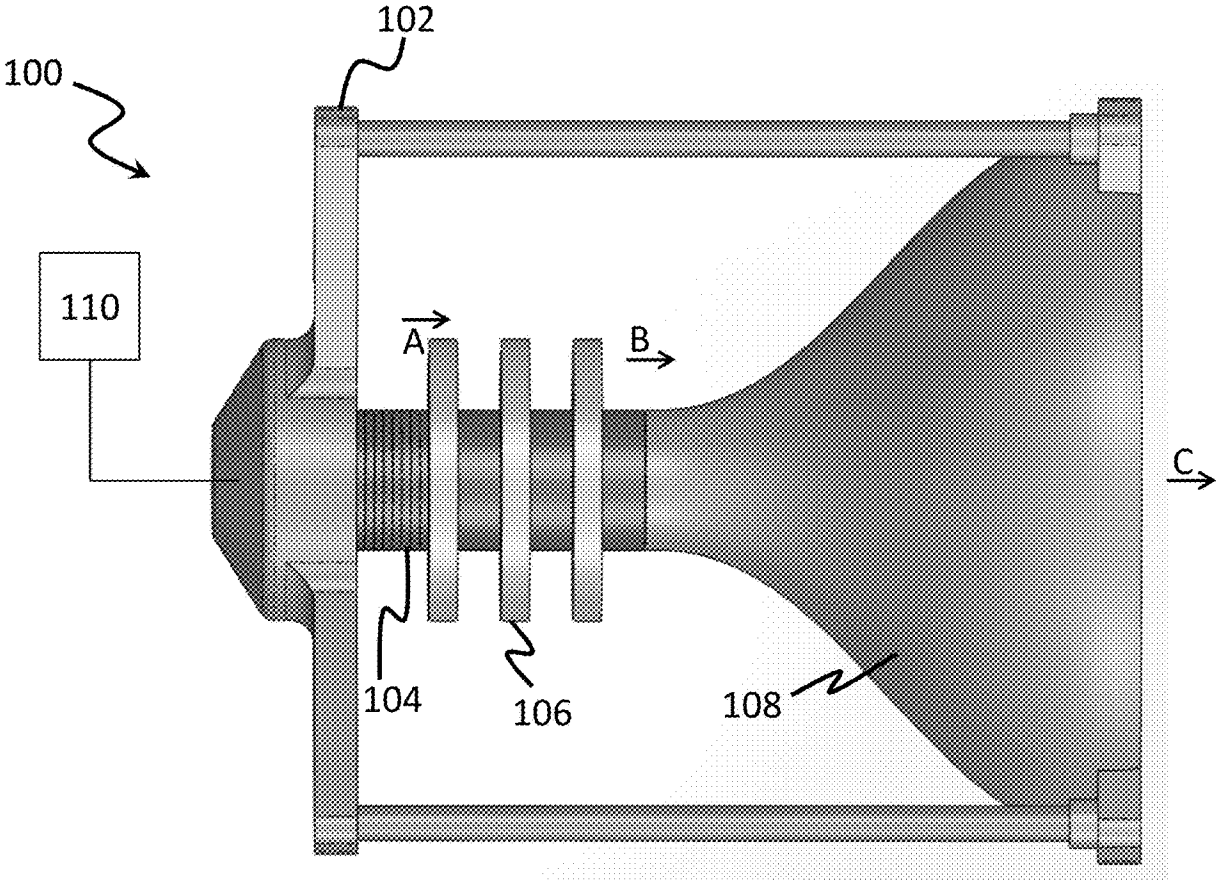
FIG. 1 shows a schematic of an acoustic wave generator in accordance with an exemplary embodiment of the invention.

Referring to FIG. 1, a schematic of an acoustic wave generator 100 in accordance with an exemplary embodiment of the invention is shown. Acoustic wave generator 100 includes three general components housed or supported within a frame 102 or other structure, such as a housing, enclosure, etc. A first component is an acoustic actuator, generator, transducer, or other similar device, hereinafter acoustic generator 104. A second component is an acoustic gate 106. A third component is an acoustic horn 108. Generally speaking, the acoustic generator 104 is configured to generate a source of acoustic energy, which then transfers or travels through the gate 106 (when the gate is open), and finally is amplified or altered in horn 108, and transmitted from the acoustic wave generator 100. In order to generate sufficient energy for acoustic wave generation, energy is contained, stored, and/or amplified within the acoustic generator 104 prior to opening of the gate 106. Those of skill in the art will appreciate that the acoustic horn 108 may be optional, and an acoustic wave generator in accordance with the present disclosure may be formed with only an acoustic actuator and an acoustic gate.

The acoustic generator 104 generates acoustic energy using low instantaneous electrical power and further stores the generated acoustic energy until sufficient energy is available to emit a high power acoustic pulse. Synchronous excitation is employed to accumulate energy at resonance within the acoustic generator 104. To achieve this, the acoustic generator 104 may be formed as an acoustic transducer. In such an exemplary configuration, the acoustic transducer minimizes electrical power requirements by storing and quickly releasing acoustic energy. To perform the charge and discharge function, the acoustic wave generator 100 includes: the acoustic generator 104, which, for example, may be configured as a generator that transforms electrical power into coherent acoustic energy, and also can gradually build up and store the generated energy; the gate 106, which, for example, may be configured as a metamaterial gate that enables the storage within the acoustic generator 104 or the release of acoustic of energy by forming a reflective or transmissive medium depending on the state of the gate 106; and the optional horn 108 which may be configured to match the acoustic impedance between the acoustic wave generator 100 (emitting medium) and the environment in which acoustic energy is to be radiated (receiving medium), and therefore maximize energy transfer.

As used herein, metamaterials that may be used to form the gate, or other components of the acoustic wave generator, may be artificial materials engineered to have properties that have not yet been found in nature. For example, they are assemblies of multiple individual elements fashioned from conventional materials such as metals or plastics, but the materials are usually constructed into repeating patterns, often with microscopic structures. Various shapes, geometries, sizes, orientations, and/or arrangements of the metamaterials can be configured to modify acoustic energy in a manner not observed in natural materials. These metamaterials achieve desired effects by incorporating structural elements of sub-wavelength sizes, i.e. features that are actually smaller than the wavelength of the waves they affect. Thus, those of ordinary skill in the art will appreciate the various configurations and selections for metamaterials that are appropriate to form an acoustic gate or the other various components described herein.

An exemplary embodiment of the acoustic generator 104 may be built as stacked layers of strain mismatched piezoelectric ceramics/crystals with interleaving electrical layers, as described below. Acoustic wave generators in accordance with various embodiments disclosed herein, such as acoustic wave generator 100, are capable of producing amplified coherent sound through a non-linear high gain medium consisting of bi-or-multi-layers of piezoelectric ceramic crystal sandwiches formed with interfacial strain for non-linearity and interleaving electrodes. In accordance with some embodiments, when the acoustic generator 104 is driven by a series of external electrical oscillators, the acoustic energy is phase separated in such a manner that an acoustic wave is phase matched between various layers of the acoustic generator 104. As a result, the acoustic energy may be stored and amplified, thus requiring little energy input for a relatively large energy generation or output. After generation, the sound is maintained in an acoustic cavity, which may be formed by the acoustic generator 104. Transmission from the acoustic generator 104 occurs when the gate 106 is opened and the acoustic energy is transferred through and out of the acoustic horn 108. As such, energy generally flows, as indicated by the arrows A, B, C, and D, from left to right in FIG. 1, starting at the acoustic generator 104, passing into the gate 106 in direction A, into the horn 108 in direction B, and exiting the acoustic wave generator 100 at horn 108 in direction C. However, when the gate 106 is closed, the energy may be confined within the acoustic generator 104, and thus the energy may be reflected and travel in direction D when the gate 106 is closed.

As shown in FIG. 1, a controller 110 may be operationally connected to the acoustic wave generator 100. The controller 110 may include one or more processors and/or memory devices configured to store and execute control algorithms and functions. As such, the controller 110 may be configured to provide operational control over the acoustic wave generator 100. The controller 100 may be configured to control one or more components of the acoustic wave generator 100, such as controlling the acoustic generator 104, the gate 106, and/or the horn 108.

Figure 2:
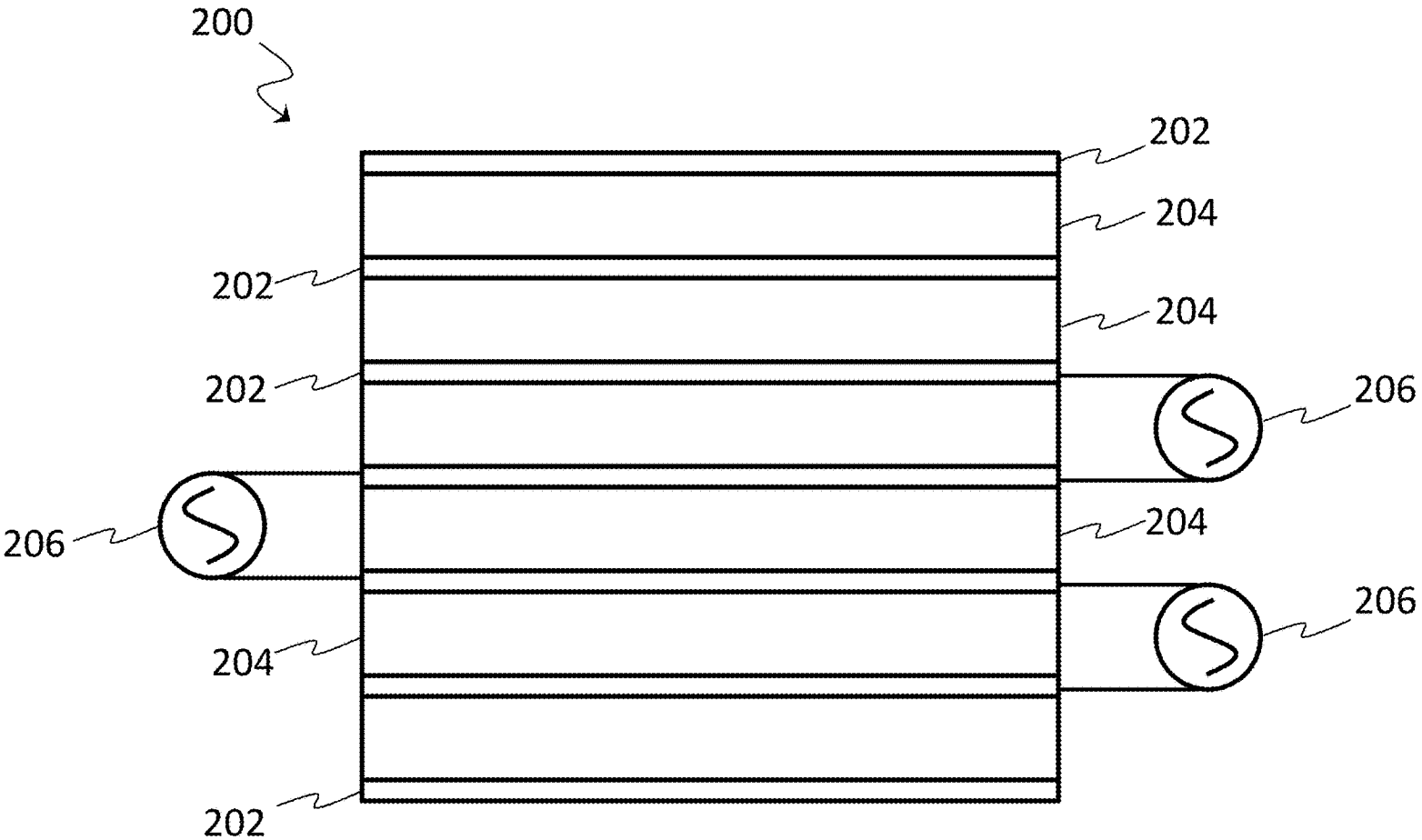
FIG. 2 shows a schematic of an acoustic generator in accordance with an exemplary embodiment of the invention.

Turning now to FIG. 2, a schematic of an acoustic generator 200 in accordance with an exemplary embodiment is shown. The acoustic generator 200 may require electronics to drive and control the device, for example to generate and store acoustic energy therein. A controller may be configured to control the acoustic generator. In some embodiments, the controller may be an electronic controller configured to operationally control the generator, the gate, and/or the horn. For example, the acoustic generator 200 is a generator of acoustic waves that is configured to convert electrical energy into mechanical energy and further configured to store the converted mechanical energy within the acoustic generator 200. Thus, acoustic generator 200 is not only a generator but also an acoustic energy storage cavity or device. In some embodiments, to control the state of the acoustic generator, a controller may be configured to operationally control the gate to provide increased performance through use of control algorithms.

To achieve acoustic energy generation, amplification, and storage, the acoustic generator 200 is formed as a stack that includes a plurality of first layers 202 that are sources of electrical or magnetic energy, such as electrodes, and a plurality of second layers 204 that are formed from materials that can change mechanical properties by application of electricity and/or magnetism, such as piezoelectric ceramics and/or crystals or magnetostrictive materials, though not limited thereto. The second layers 204 can change mechanical properties when an external energy or power is applied thereto, such as by converting electrical and/or magnetic energy into kinetic energy. For example, the second layers may be configured to convert electrical and/or magnetic energy to kinetic energy by changing shape and/or size when the electrical and/or magnetic energy is applied to the material of the second layers. Thus acoustic generator 104 generates acoustic energy (kinetic energy) through electric and/or electromagnetic actuation of the second layers 204. The plurality of first layers 202 and the plurality of second layers 204 form bi-or-multi-layer sandwiches or stack. The application of electricity and/or magnetism to the second layer 204 through first layer 202 causes the second layer 204 to actuate and change mechanical properties, and the change in mechanical properties generates acoustic energy, such as in the form of vibrations within the material of second layers 204.

As shown schematically in FIG. 2, a number of oscillators 206 are connected to the electrode first layers 202. Although shown with only three oscillators 206, those of skill in the art will appreciate that different numbers and configurations of oscillators may be provided without departing from the scope of the invention. In some alternative embodiments, the oscillators 206 may be configured as or in connection with a controller. Thus, the oscillators 206, in some embodiments, are configured to control the acoustic energy generation within the generator 200.

By applying synchronized time varying signals from the oscillators 206 at each electrode first layer 202 an acoustic field and/or waveform in the acoustic generator 200 can be created and manipulated. By selecting a driving frequency corresponding to or close to a resonance of the stack of the acoustic generator 200, and by phasing adequately all driving signals to support the underlying mode shape of the resonance, energy is accumulated in the resonance of the acoustic generator 200. In this manner, the acoustic generator 200 also forms an acoustic cavity for energy storage.

In an exemplary embodiment, the acoustic generator 200 is formed of layers 204 of piezoelectric or magnetostrictive materials that can be independently actuated by layers 202 with phases such that the phasing creates and sustains a pressure or acoustic wave within the acoustic generator 200. Maximum output of the acoustic generator 200 can be achieved if the frequency of excitation is at a resonance frequency of the acoustic generator 200. In this way, is it possible to produce a large energy build or output with minimal energy input. In some embodiments, layers of other materials (e.g., steel, lead, etc.) can be interspersed between the piezoelectric or magnetostrictive materials to adjust the resonance characteristics (Q factor, resonance frequency) of the acoustic generator 200. The acoustic generator 200 can be shaped as a cylinder, bar, ellipsoid, or any other one or two dimensional shape depending on the types of waves that are to be generated (e.g., planar, spherical, etc.). Further, in some embodiments other shapes, such as three dimensional shapes may be used. Moreover, the acoustic generator may be formed of a coiled or wound structure to enable a reduced size and/or volume of the acoustic generator while maintaining the low input-high output aspects of the invention.

Those of skill in the art will appreciate that in some embodiments a third layer formed of one or more layers of material that may be provided and/or configured within the acoustic generator to provide additional materials that are optimized for energy storage. For example, the third layer may be formed of a material with a high Q Factor that is configured to have a low rate of energy loss relative to the energy generated and stored within the acoustic generator. For example, the third layer may include, but not be limited to, quartz, lead zirconate titanate, tourmaline, aluminum nitride, zinc oxide, gallium nitride, silicon, photonic crystals, etc. Further, those of skill in the art will appreciate that the selection of material for the first and/or second layers described above may be configured to provide the storage capability, and thus a third layer is optional.

Figure 3:
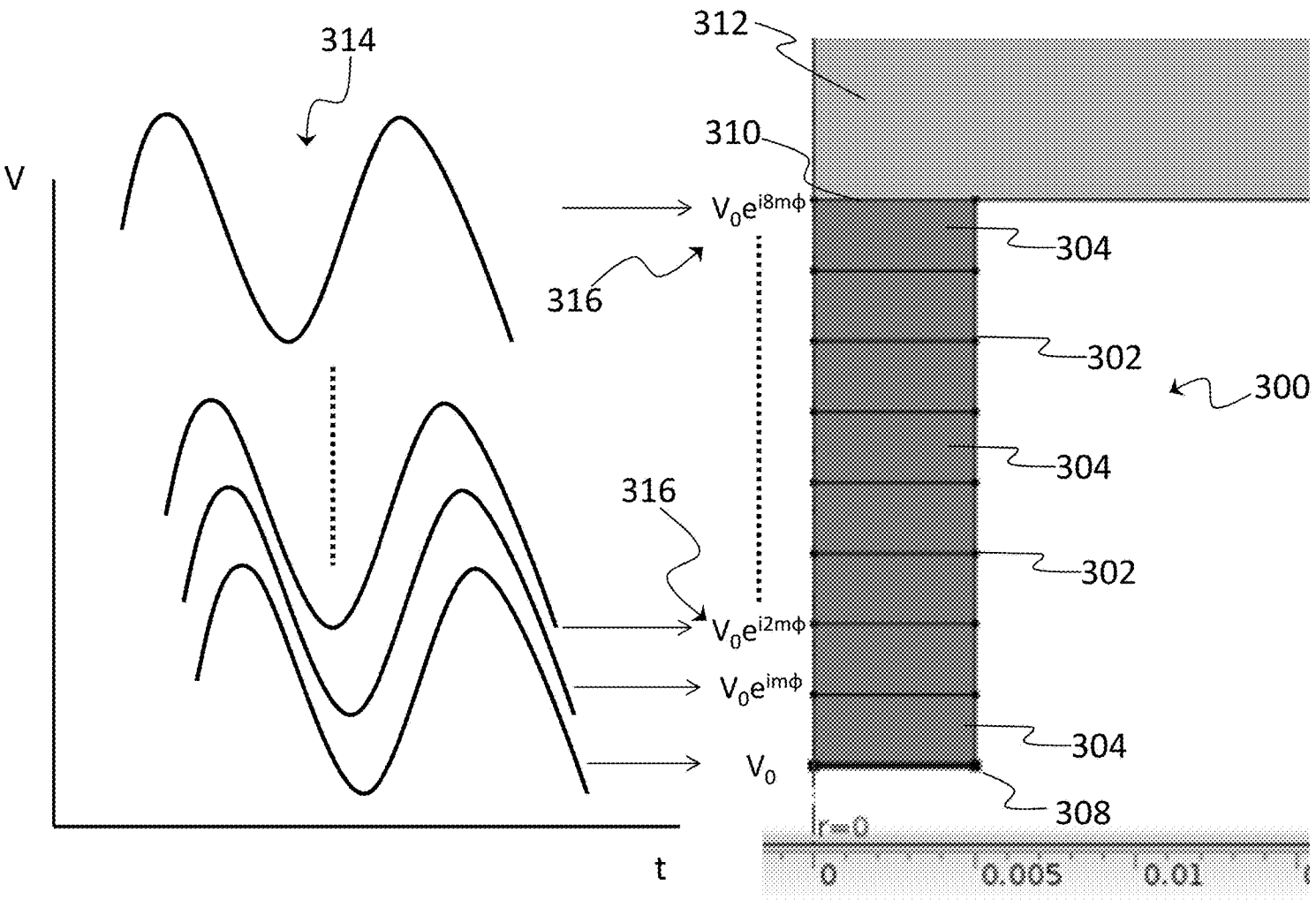
FIG. 3 shows a schematic of the operation of an acoustic generator in accordance with an exemplary embodiment of the invention.

Turning now to FIG. 3, a schematic example of an acoustic generator 300 in accordance with embodiments of the invention is shown. Acoustic generator 300 is formed as a stack of a plurality of first layers 302 which are configured as electrodes and a plurality of second layers 304 which are configured as electric/electromagnetic responsive materials, as described above and substantially similar to acoustic generator 200 of FIG. 2. The acoustic generator 300 includes a base or first end 308 and a gate 312 or other similar device is provided at a top or second end 310 of the acoustic generator 300. Energy generated within the acoustic generator 300, such as acoustic energy generated by the actuation of second layers 304, can be stored, retained, and/or accumulated within the acoustic generator 300 by energy and/or wave reflection within the acoustic generator 300 between the base 308 and the gate 312, when the gate 312 is in a closed position. To achieve this, base 308 and gate 312 (in the closed position) at top 310 are configured to be reflective surfaces and/or interfaces for the mechanical/acoustic energy that is generated within the acoustic generator 300.

In operation, a plurality of excitation levels are provided to the various electrode first layers 302. As shown, a plurality of waveforms 314 of different voltages can be provided, such that increasing voltages can be provided from the base 308 to the top 310 of the first layers 302 within acoustic generator 300 and imparted to the second layers 304. For example, a base voltage $V_0$ may be provided to an electrode layer 302 located at the base 308. Then, at the next electrode first layer 302 within the acoustic generator 300, a second voltage $V_0e^{im\Phi}$ may be applied. Next, a higher voltage $V_0e^{i2m\Phi}$ may be applied to the next sequential electrode first layer 302. The increased voltage levels may be sequentially applied to each first layer 302 within the acoustic generator 300. For example, in FIG. 3, there are nine first layers 302 shown, starting at base 308 at a voltage level of $V_0$ and a first layer 302 at the interface between the acoustic generator 300 and the gate 312 at a voltage level of $V_0e^{i8m\Phi}$. Each voltage application may have a different phase excitation for each layer to thus create a resonance wave within the acoustic generator 300. In addition to different voltages and/or phases, those of skill in the art will appreciate that the dimensions, shapes, sizes, configurations, etc. of the second layers 304 may be configured such that a specific resonant frequency may be achieved.

Figure 4A:
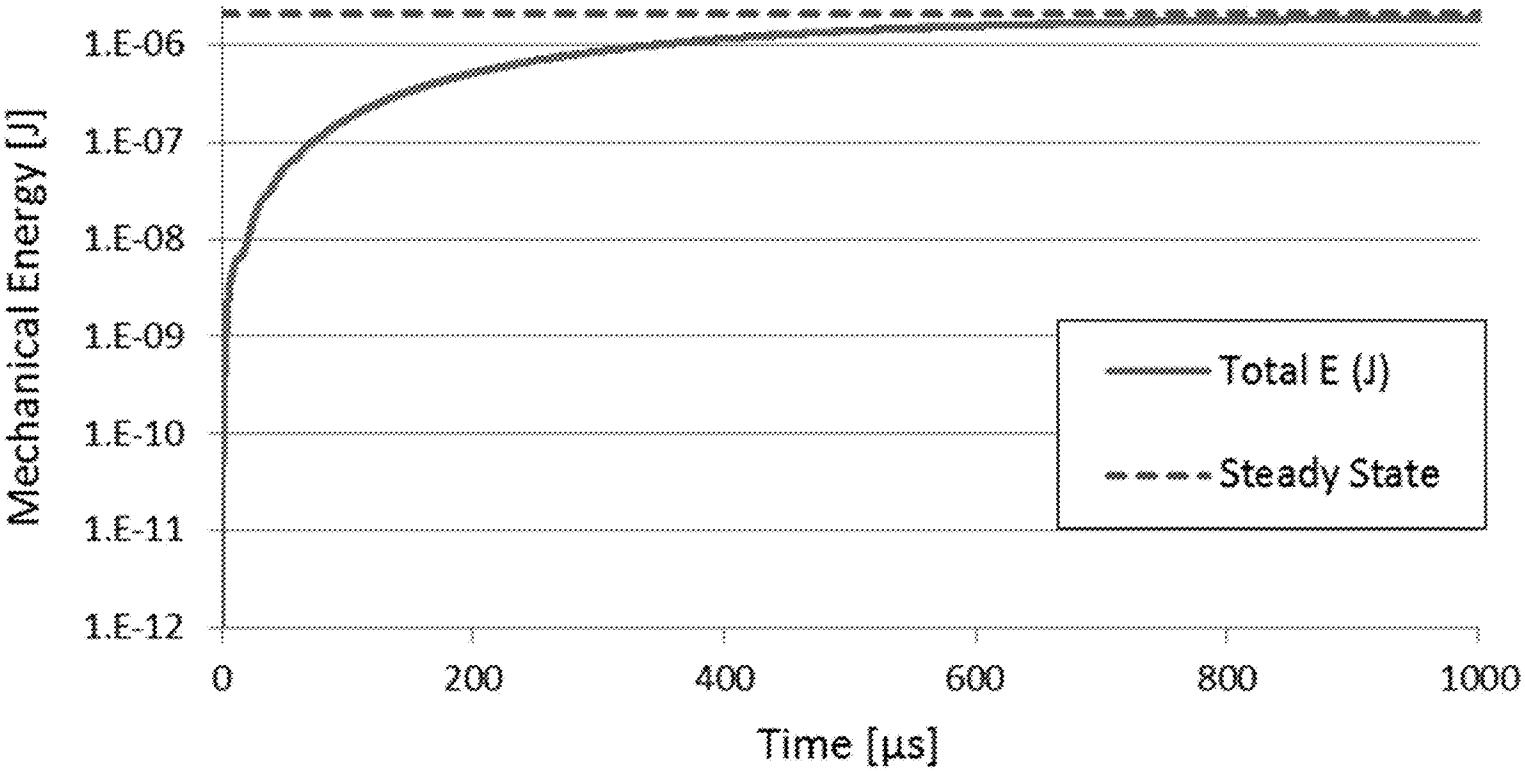
FIG. 4A is a plot of exemplary data of the mechanical energy accumulation in acoustic generators in accordance with the invention.
Figure 4B:
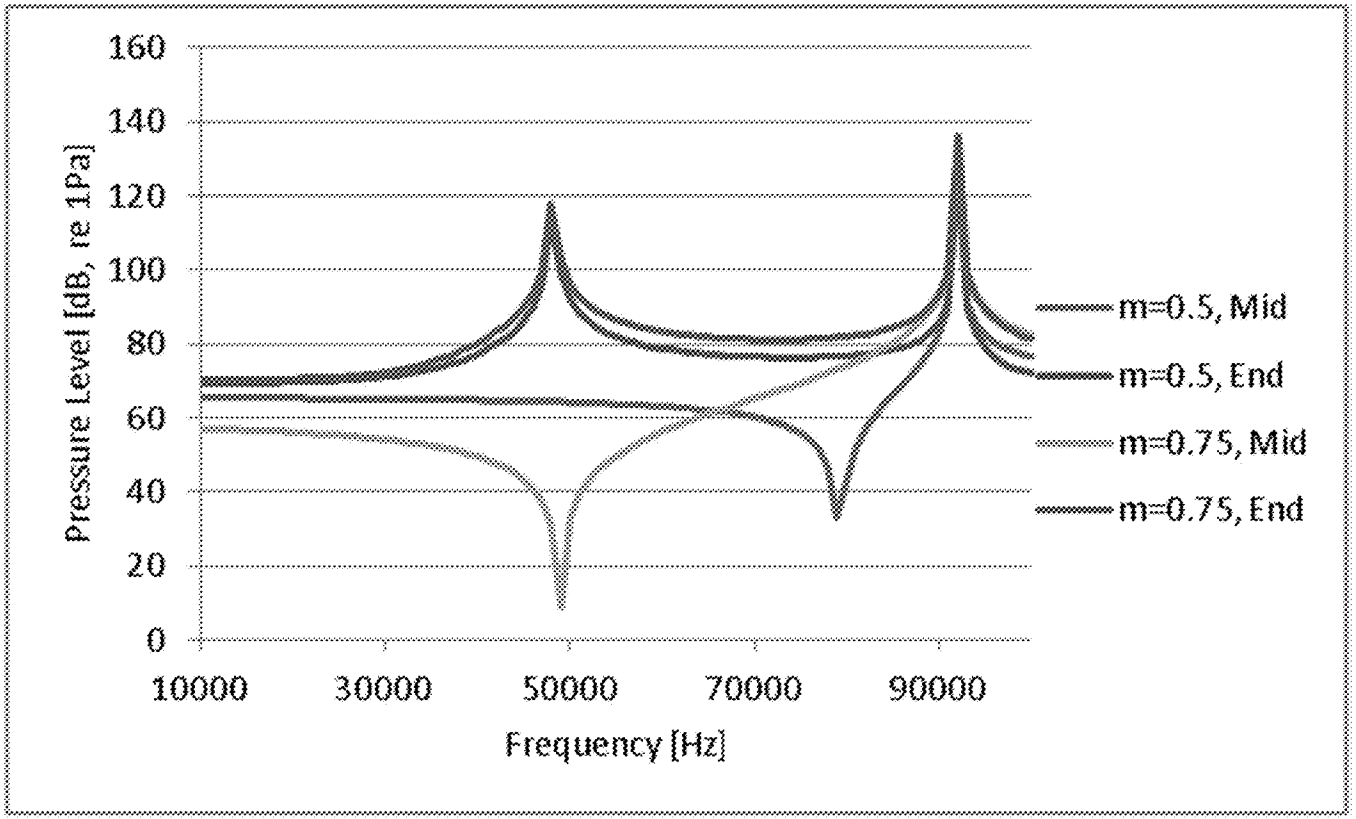
FIG. 4B is an exemplary plot of generator pressure levels at various exemplary frequencies in accordance with the use of acoustic generators in accordance with the invention.

For example, time-domain finite element model predictions illustrate the accumulation of mechanical energy as demonstrated in FIG. 4A when using acoustic generators such as acoustic generators 200, 300. In FIG. 4A, the horizontal axis is the time domain in micro-seconds ("μs") and the vertical axis is mechanical energy in Joules ("J"). At each cycle, e.g., 20 μs to 100 ms (a function of the frequency operation), a small amount of electrical energy, e.g., μJ to kJ (depending on size of elements and how hard the system is driven), is brought into the system, and is converted into mechanical energy which adds to the mechanical energy already in the generator. Turning now to FIG. 4B, a plot of frequency in hertz (Hz) along the horizontal axis and pressure level in dB, re 1 Pa. As shown there are high pressure waves at resonance frequencies for a low power input, which can thus result in a high power output. Thus, as pressure increases, resonance increases, and the two build upon each other to increase the energy within the acoustic generator.

Equilibrium is reached when the amount of electrical (mechanical) energy pumped into the acoustic generator corresponds to the energy lost by the acoustic generator at each cycle. Losses are a function of the material losses and the energy leakage into components connected to the actuator. Advantageously, even in a sample testing that employed a material with relatively high losses, when the stored energy was released in one cycle the peak power demand was estimated to be over thirty times smaller than the peak power demand of a system without energy storage.

To release the energy that is stored or accumulated within the acoustic generator, the gate may be transitioned from a closed position to an open position. As noted above, when the gate is in the closed position it is configured to form a reflective surface or interface between the gate and the acoustic generator, thus containing energy within the acoustic generator. However, when the gate is in the open position, the energy may be transmitted through the gate and into the environment, i.e., be emitted or transmitted. In some embodiments, as noted above, a horn may be located sequentially after the gate and configured to enable modification of the energy transmitted from the actuator in an effort to maximize energy transmission between the acoustic wave generator and the environment. For example, a horn in accordance with embodiments of the invention can be configured to provide radiation control and/or focusing of the transmitted energy, to enable an efficient energy transfer between the mediums.

Figure 5:
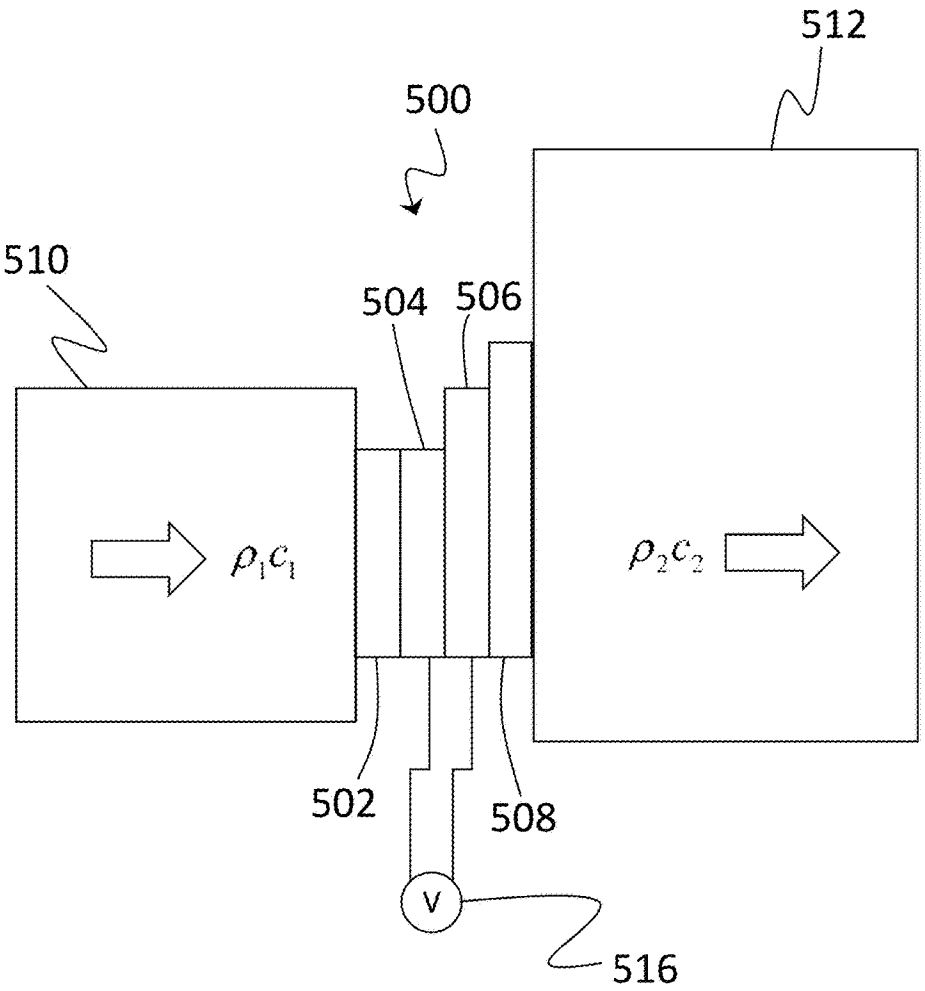
FIG. 5 is a schematic of an acoustic horn in accordance with an exemplary embodiment of the invention.

Turning now to FIG. 5, a schematic of an acoustic horn in accordance with an exemplary embodiment of the invention is shown. The horn 500 may be an acoustic horn that is configured to maximize the energy transfer between the acoustic generator of the acoustic wave generator and the propagating domains of the environment to which the energy is transmitted by matching the characteristic acoustic impedances between the device and the environment. In order to deliver a pulse of energy efficiently out of the acoustic wave generator, the acoustic horn 500 is configured to match the impedance of the gate (e.g., a solid) to that of the environment (e.g., a fluid such as water). It is noted that, if the acoustic wave generator is configured to radiate into a solid of comparable characteristic impedance with the gate, no horn may be necessary. Thus, as noted, the horn is an optional feature of the acoustic wave generator device. In some embodiments, the horn, if included, can be formed as an integral part of the gate.

Transmission of acoustic energy between two different media, e.g., a solid and a fluid, may be difficult or energy inefficient as there is a strong discontinuity of acoustic impedances at the interface between the media. Acoustic waves typically propagate very fast in solids (e.g., metals) and much slower in fluids (e.g., air or water or other gases and/or liquids). Without proper impedance matching, the acoustic energy does not transmit well at the interface between the two media, and energy may be reflected resulting in a reduced amount of energy that may be transmitted from the acoustic wave generator. An acoustic horn, such as acoustic horn 500, is configured to enhance the energy transmission between two media by progressively matching impedances. For example, the horn 500 can progressively match the impedances of the gate of the acoustic wave generator and the environment.

In some exemplary embodiments, the horn 500 may be formed of a metamaterial or one or more layers of metamaterial. As shown in FIG. 5, horn 500 is formed from multiple layers 502, 504, 506, 508. The horn 500 is an impedance matching device between two distinct media, e.g., one acoustically fast and one acoustic slow. For example, to the left of horn 500 in FIG. 5 may be an acoustic energy source 510, such as a gate and/or an actuator as described above. To the right of horn 500 in FIG. 5 may be an environment 512 into which acoustic energy is desired to be transmitted (see also FIG. 1). The acoustic source 510 and the environment 512 may have different impedances, and thus at an interface reflections and reduced energy transmission may occur. However, as shown in FIG. 5, the horn 500 is located at the interface between the acoustic source 510 and the environment 512, i.e., between the two, and thus the impedance of the two materials may be matched.

As noted, the horn 500 is formed of or from thin layers 502, 504, 506, 508 of various materials with carrying dimensions, e.g., frequency, power, etc. The configuration of layers 502, 504, 506, 508 transforms progressively the acoustic impedance from the emitting medium (acoustic source 510) to the receiving medium (environment 512). For example, in some exemplary embodiments, active elements (e.g., piezoelectric, magnetostrictive materials) may be embedded in and/or form the horn 500, i.e., various active elements may form the layers 502, 504, 506, 508. The mechanical properties of the active elements can be modified/manipulated using electric and/or electromagnetic input, similar to that described above with respect to the acoustic generator. For example, by manipulating a current applied to the active elements, the horn 500 can prevent backflow of energy at the interface between horn 500 and the acoustic source 510, such as at point 310 in FIG. 3. As shown in FIG. 5, an electrical, magnetic, or other power source 516 may be provided in operational communication with one or more elements of the horn 500. This enables the active element(s), such as layers 502, 504, 506, 508 to be manipulated to achieve improved impedance matching and thus improved energy transmission from the acoustic source 510 to the environment 512. In some embodiments, the power source 516 is configured as a controller, wherein the power source includes one or more processors and/or memory and is configured to operate algorithms to provide control of the horn 500.

In the example of FIG. 5, acoustic energy or waves will travel through materials based on the speed of sound in the material (c) and the sound pressure within the material (ρ), and when a transition is made between materials such as a change in the acoustic impedance, an inefficient transition will occur. Thus, if the material of acoustic source 510 is different from the material of environment 512, the impedances of the two materials may be different, thus causing reflections and decreased energy transfer at the interface between the two materials. For example, in FIG. 5, if $\rho_1 c_1$ does not equal $\rho_2 c_2$, the impedance difference at the interface between the two will cause at least some of the acoustic energy to reflect back into the source 510, rather than transmit into the environment 512. Thus, horn 500, and layers 502, 504, 506, 508 thereof, are configured to match the impedance of source 510 and environment 512 such that $\rho_1 c_1$ equals $\rho_2 c_2$ during operation.

Advantageously, an acoustic wave generator is provided that enables low energy consumption when transmitting acoustic waves. Further, in accordance with some embodiments, the acoustic generator of the acoustic wave generator functions as an energy storage device and energy amplifier such that minimal energy needs to be input to generate a high energy output. Advantageously, this energy storage mechanism and release has the potential to reduce the peak power needs of the system. For example, the reduction in peak power needs may be about fifty times less when compared to the energy needed over one cycle for a transducer without energy storage. Moreover, advantageously, short duration power pulse acoustic transduction in accordance with embodiments of the invention may enable a new class of low observable underwater intelligence, surveillance and reconnaissance and communication devices, by focusing acoustic energy into a dedicated spectral band receiver.

Further, advantageously, in accordance with some embodiments of the invention, an acoustic generator employs and exploits synchronous excitation to accumulate energy at resonance, rather than using stimulated emission. This difference profoundly alters the operation of the transducer/actuator, and permits much lower frequency range of excitation, potentially down to about 100-500 Hz or lower, making this new technology suitable for underwater acoustic communication and detection.

Furthermore, advantageously, because acoustic generators in accordance with some embodiments are configured to be controlled, in part, by the application of electromagnetic input, the actuator may be tunable such that a single device of small construction and packaging can be provided to generate acoustic waves at various predetermined frequencies, for example between 100 Hz to 500 kHz, although other frequencies and/or ranges are possible.

Furthermore, advantageously, embodiments of the invention may be used for various purposes. For example, sonic devices in accordance with embodiments of the invention that use acoustic wave generation may be used in detection applications, health care industry, including high power ultrasonics for non-invasive surgery, inspection of organs/tissue, and/or imaging, stone acoustic pulverization, instrumentation, gas leak sensing, underwater sonar devices, and/or for hijacking and/or terrorist threat deterrents.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments and/or features.

For example, although various embodiments have been described above with specific numbers of layers or features, those of skill in the art will appreciate that these numbers are merely presented for exemplary and explanatory purposes and the numbers and configurations may be changed without departing from the scope of the invention. Further, although described herein as employing piezoelectric layers, those of skill in the art will appreciate that other types of layers may be used without departing from the scope of the invention. For example, any material that can be actuated or induced to change mechanical properties and thus generate energy, including but not limited to magnetostrictive materials, may be used without departing from the scope of the invention.

Further, for example, although various embodiments of the invention have been described with respect to a transition between a solid and a fluid, such as a gas or liquid, those of skill in the art will appreciate that a horn as disclosed herein may be used for energy transfer between two solids that have differing impedances, or between any two materials or environments.

Accordingly, the invention is not to be seen as limited by the foregoing description, but is only limited by the scope of the appended claims.

What is claimed is:

1. An acoustic wave generator comprising:

a stack comprising:

a plurality of first layers configured to receive electrical and/or magnetic energy; and a plurality of second layers configured in contact with the plurality of first layers, the plurality of second layers comprising one or more materials configured to change mechanical properties when electrical and/or magnetic energy is applied thereto; and at least one source configured in operational communication with the plurality of first layers and configured to supply at least one of phased electrical and/or magnetic energy to the plurality of first layers, wherein the stack is configured to (i) generate phased acoustic energy and (ii) at least one of amplify and store the generated acoustic energy in a first state and release said generator acoustic energy in a second state.

2. The acoustic wave generator of claim 1, wherein at least one of the plurality of first layers comprises an electrode.

3. The acoustic wave generator of claim 1, wherein at least one layer of the plurality of second layers comprises at least one of a piezoelectric material and a magnetostrictive material.

4. The acoustic wave generator of claim 3, wherein at least one layer of the plurality of second layers comprises a piezoelectric ceramic or a piezoelectric crystal.

5. The acoustic wave generator of claim 1, wherein the plurality of first layers and the plurality of second layers form a stack with a repeating pattern of a first layer, followed by a second layer, followed by another first layer, followed by another second layer.

6. The acoustic wave generator of claim 1, further comprising a gate configured to have a closed state and an open state, wherein when the gate is in the closed state the stack is in the first state and when the gate is in the open state the stack is in the second state.

7. The acoustic wave generator of claim 6, wherein the gate is formed of a metamaterial.

8. The acoustic wave generator of claim 1, further comprising a horn configured to modify an acoustic impedance of the generated phased acoustic energy prior to transmission of the phased acoustic energy from the acoustic wave generator.

9. The acoustic wave generator of claim 8, wherein the horn is configured to match an impedance of the generated phased acoustic energy with an impedance of a material into which the phased generated acoustic energy is to be transmitted.

10. The acoustic wave generator of claim 1, further including at least one third layer in the stack, the third layer configured to store acoustic energy when the stack is in the first state.

11. The acoustic wave generator of claim 10, wherein the at least one third layer comprises a high Q Factor material.

12. A method of transmitting acoustic energy comprising:

Generating phased acoustic energy within a stack having a plurality of first layers and a plurality of second layers;

storing the phased generated acoustic energy within the stack in a first state; and releasing the phased generated acoustic energy within the stack in a second state.

13. The method of claim 12, wherein the plurality of first layers are configured to receive electrical and/or magnetic energy, and the plurality of second layers are configured in contact with the plurality of first layers, the plurality of second layers comprising one or more materials configured to change mechanical properties when electrical and/or magnetic energy is applied thereto.

14. The method of claim 12, further comprising:

closing a gate to place the stack in the first state; and opening the gate to place the stack in the second state.

15. The method of claim 12, further comprising altering the acoustic impedance of the generated phased acoustic energy to match an acoustic impedance of a material into which the acoustic energy is to be transmitted.

* * * * *